US007775644B2

(12) United States Patent
Silverbrook

(10) Patent No.: US 7,775,644 B2
(45) **Date of Patent: *Aug. 17, 2010**

(54) PRINTHEAD ASSEMBLY WITH AN INK SUPPLY CARRIER SUPPORTING AN INK DISTRIBUTING MOLDING

(75) Inventor: Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 0 days.

This patent is subject to a terminal disclaimer.

(21) Appl. No.: 12/433,901

(22) Filed: May 1, 2009

(65) Prior Publication Data

US 2009/0213192 A1 Aug. 27, 2009

Related U.S. Application Data

(63) Continuation of application No. 11/635,525, filed on Dec. 8, 2006, now Pat. No. 7,537,323, which is a continuation of application No. 11/250,451, filed on Oct. 17, 2005, now Pat. No. 7,168,796, which is a continuation of application No. 10/986,346, filed on Nov. 12, 2004, now Pat. No. 7,055,940, which is a continuation of application No. 10/713,088, filed on Nov. 17, 2003, now Pat. No. 6,827,427, which is a continuation of application No. 10/129,503, filed as application No. PCT/AU01/00239 on Mar. 6, 2001, now Pat. No. 6,676,245.

(30) Foreign Application Priority Data

Mar. 6, 2000 (AU) ..... PQ6058

(51) Int. Cl.
*B41J 2/175* (2006.01)

(52) U.S. Cl. ..... 347/85

(58) Field of Classification Search ..... 347/20, 347/40–43, 49–50, 54, 56, 59, 65–71, 85
See application file for complete search history.

(56) References Cited

U.S. PATENT DOCUMENTS

| | | | | |
|---|---|---|---|---|
| 6,270,196 | B1 | 8/2001 | Uno et al. | |
| 6,676,245 | B2 | 1/2004 | Silverbrook | |
| 7,314,266 | B2 | 1/2008 | Silverbrook | |
| 7,467,848 | B2 * | 12/2008 | Silverbrook | 347/42 |
| 7,537,323 | B2 * | 5/2009 | Silverbrook | 347/85 |
| 7,549,724 | B2 * | 6/2009 | Silverbrook | 347/42 |
| 2004/0095413 | A1 | 5/2004 | Silverbrook | |
| 2007/0035595 | A1 | 2/2007 | Silverbrook | |
| 2007/0046729 | A1 | 3/2007 | Silverbrook | |

FOREIGN PATENT DOCUMENTS

| | | | |
|---|---|---|---|
| EP | 0841166 | A | 5/1998 |

(Continued)

*Primary Examiner*—K. Feggins

(57) ABSTRACT

A printhead assembly with a printhead integrated circuit (IC) for ejecting ink, an elongate molding which defines a recess for holding the printhead IC, and an elongate support member which supports the elongate molding. The molding defines a plurality of separate ink passages, each in fluid communication with the printhead IC. The elongate support member defines a plurality of separate ink reservoirs each in fluid communication with a respective ink passage. Each of the ink reservoirs extends axially along the support member. The support member has a core element that defines the ink reservoirs and a shell in which the core element can be received.

8 Claims, 1 Drawing Sheet

FOREIGN PATENT DOCUMENTS

| | | | |
|---|---|---|---|
| JP | 06-087213 | A | 3/1994 |
| JP | 6087213 | A | 3/1994 |
| JP | 10-157105 | A | 6/1998 |
| JP | 11-010861 | A | 1/1999 |
| JP | 2000-263768 | A | 9/2000 |

* cited by examiner

PRINTHEAD ASSEMBLY WITH AN INK SUPPLY CARRIER SUPPORTING AN INK DISTRIBUTING MOLDING

CROSS-REFERENCES TO RELATED APPLICATIONS

This is a Continuation Application of U.S. application Ser. No. 11/635,525 filed Dec. 8, 2006, which is a Continuation of U.S. application Ser. No. 11/250,451 filed on Oct. 17, 2005, now issued U.S. Pat. No. 7,168,796, which is a Continuation Application of U.S. application Ser. No. 10/986,346 filed Nov. 12, 2004, now issued U.S. Pat. No. 7,055,940, which is a Continuation Application of U.S. application Ser. No. 10/713,088, filed on Nov. 17, 2003, now issued U.S. Pat. No. 6,827,427, which is a Continuation Application of U.S. application Ser. No. 10/129,503, filed on May 6, 2002, now issued U.S. Pat. No. 6,676,245, which is a 371 of PCT/AU01/00239, filed on Mar. 6, 2001 all of which are herein incorporated by reference.

FIELD OF THE INVENTION

The present invention relates to printers and in particular to digital inkjet printers.

CO-PENDING APPLICATIONS

Various methods, systems and apparatus relating to the present invention are disclosed in the following co-pending applications filed by the applicant or assignee of the present invention on 24 May 2000:

| | | | |
|---|---|---|---|
| PCT/AU00/00578 | PCT/AU00/00579 | PCT/AU00/00581 | PCT/AU00/00580 |
| PCT/AU00/00582 | PCT/AU00/00587 | PCT/AU00/00588 | PCT/AU00/00589 |
| PCT/AU00/00583 | PCT/AU00/00593 | PCT/AU00/00590 | PCT/AU00/00591 |
| PCT/AU00/00592 | PCT/AU00/00584 | PCT/AU00/00585 | PCT/AU00/00586 |
| PCT/AU00/00594 | PCT/AU00/00595 | PCT/AU00/00596 | PCT/AU00/00597 |
| PCT/AU00/00598 | PCT/AU00/00516 | PCT/AU00/00517 | PCT/AU00/00511 |

Various methods, systems and apparatus relating to the present invention are disclosed in the following co-pending application, PCT/AU00/01445 filed by the applicant or assignee of the present invention on 27 Nov. 2000. The disclosures of these co-pending applications are incorporated herein by cross-reference. Also incorporated by cross-reference, is the disclosure of a co-filed PCT application, PCT/AU01/00238 (deriving priority from Australian Provisional Patent Application No. PQ6059).

BACKGROUND OF THE INVENTION

Recently, inkjet printers have been developed which use printheads manufactured by micro-electro mechanical system(s) (MEMS) techniques. Such printheads have arrays of microscopic ink ejector nozzles formed in a silicon chip using MEMS manufacturing techniques.

Printheads of this type are well suited for use in pagewidth printers. Pagewidth printers have stationary printheads that extend the width of the page to increase printing speeds. Pagewidth printheads do not traverse back and forth across the page like conventional inkjet printheads, which allows the paper to be fed past the printhead more quickly.

To reduce production and operating costs, the printheads are made up of separate printhead modules mounted adjacent each other on a support beam in the printer. To ensure that there are no gaps or overlaps in the printing produced by adjacent printhead modules it is necessary to accurately align the modules after they have been mounted to the support beam. Once aligned, the printing from each module precisely abuts the printing from adjacent modules.

Unfortunately, the alignment of the printhead modules at ambient temperature will change when the support beam expands as it heats up during printhead operation. Furthermore, if the printhead modules are accurately aligned when the support beam is at the equilibrium operating temperature, there may be unacceptable misalignments in any printing before the beam has reached the operating temperature. Even if the printhead is not modularized, thereby making the alignment problem irrelevant, the support beam and printhead may bow because of different thermal expansion characteristics. Bowing across the lateral dimension of the support beam does little to affect the operation of the printhead. However, as the length of the beam is its major dimension, longitudinal bowing is more significant and can affect print quality.

SUMMARY OF THE INVENTION

According to the invention, there is provided a printhead assembly which comprises a support member that is mountable to a printer; and a printhead chip mounted on the support member and primarily of silicon, wherein the support member has a core reservoir structure that defines at least one ink reservoir in fluid communication with the printhead chip and a laminated outer shell comprising at least two layers of different metals selected such that a combined coefficient of thermal expansion of a lamination of the metals is substantially the same as that of silicon.

The core reservoir structure may define four reservoirs for four respective inks.

The outer shell may comprise three layers of two different metals, with an inner layer of one metal and outer layers of another metal.

The outer shell may be a hot rolled laminate.

The outer layers may be invar and the inner layer may have a coefficient of thermal expansion which is greater than that of invar.

The core reservoir structure may have a portion which extends from the shell, the printhead chip being mounted on the portion.

Accordingly, the present invention provides a printhead assembly for a digital inkjet printer, the printhead assembly including:

a support member for attachment to the printer;

a printhead adapted for mounting to the support member;

the support member having an outer shell and a core element defining at least one ink reservoir such that the effective coefficient of thermal expansion of the support member is substantially equal to the coefficient of thermal expansion of the printhead.

Preferably, the outer shell is formed from at least two different metals laminated together and the printhead includes a silicon MEMS chip. In a further preferred form, the support member is a beam and the core element is a plastic extrusion defining four separate ink reservoirs. In a particularly preferred form, the metallic outer shell has an odd number of longitudinally extending layers of at least two different metals, wherein layers of the same metal are symmetrically disposed about the central layer.

It will be appreciated that by laminating layers of uniform thickness of the same material on opposite sides of the central layer, and at equal distances therefrom, there is no tendency for the shell to bow because of a dominating effect from any of the layers. However, if desired, bowing can also be eliminated by careful design of the shells cross section and variation of the individual layer thicknesses.

In some embodiments, the printhead is a plurality of printhead modules positioned end to end along the beam.

BRIEF DESCRIPTION OF THE DRAWINGS

A preferred embodiment of the invention will now be described, by way of example only, with reference to the accompanying drawing in which.

DETAILED DESCRIPTION OF THE PREFERRED EMBODIMENTS

Figure 1:
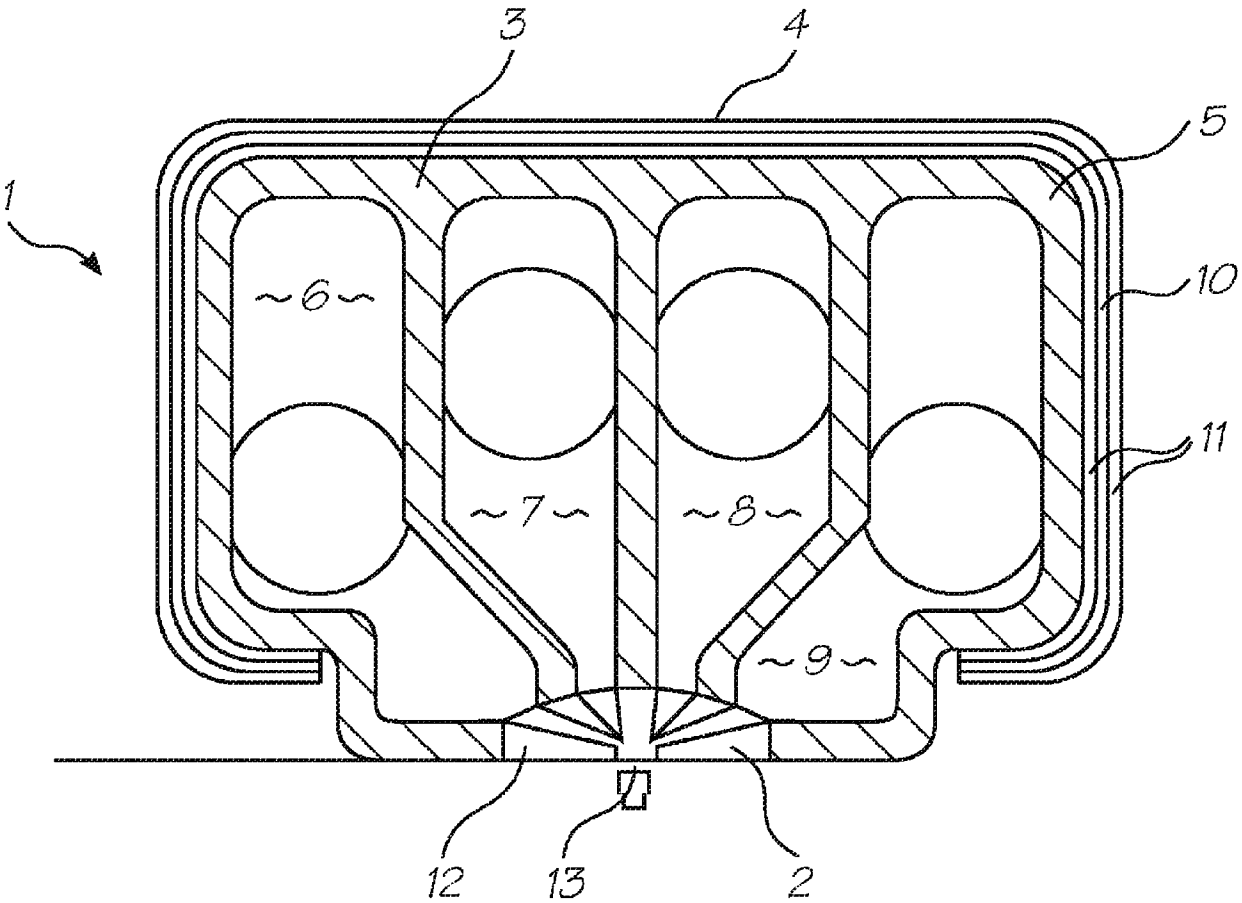
FIG. 1 is a schematic cross section of a printhead assembly according to the present invention.

Referring to the FIGURE, the printhead assembly 1 includes a printhead 2 mounted to a support member 3. The support member 3 has an outer shell 4 and a core element 5 defining four separate ink reservoirs 6, 7, 8 and 9. The outer shell 4 is a hot rolled trilayer laminate of two different metals. The first metal layer 10 is sandwiched between layers of the second metal 11. The metals forming the trilayer shell are selected such that the effective coefficient of thermal expansion of the shell as a whole is substantially equal to that of silicon even though the coefficients of the core and the individual metals may significantly differ from that of silicon. Provided that the core or one of the metals has a coefficient of thermal expansion greater than that of silicon, and another has a coefficient less than that of silicon, the effective coefficient can be made to match that of silicon by using different layer thicknesses in the laminate.

Typically, the outer layers 11 are made of invar which has a coefficient of thermal expansion of $1.3\times10^{-6}$ m/° C. The coefficient of thermal expansion of silicon is about $2.5\times10^{-6}$ m/° C. and therefore the central layer must have a coefficient greater than this to give the support beam an overall effective coefficient substantially the same as silicon.

The printhead 2 includes a micro moulding 12 that is bonded to the core element 5. A silicon printhead chip 13 constructed using MEMS techniques provides the ink nozzles, chambers and actuators.

As the effective coefficient of thermal expansion of the support beam is substantially equal to that of the silicon printhead chip, the distortions in the printhead assembly will be minimized as it heats up to operational temperature. Accordingly, if the assembly includes a plurality of aligned printhead modules, the alignment between modules will not change significantly. Furthermore, as the laminated structure of the outer shell is symmetrical in the sense that different metals are symmetrically disposed around a central layer, there is no tendency of the shell to bow because of greater expansion or contraction of any one metal in the laminar structure. Of course, a non-symmetrical laminar structure could also be prevented from bowing by careful design of the lateral cross section of the shell.

The invention has been described herein by way of example only. Skilled workers in this field will readily recognise that the invention may be embodied in many other forms.

The invention claimed is:

1. A printhead assembly comprising:

a printhead integrated circuit (IC) for ejecting ink;

an elongate molding which defines a recess for holding the printhead IC, the molding defining a plurality of separate ink passages each in fluid communication with the printhead IC; and an elongate support member which supports the elongate molding, and defines a plurality of separate ink reservoirs each in fluid communication with a respective ink passage and each axially extending along the support member; the support member comprising a core element which defines the ink reservoirs and a shell in which the core element can be received, the shell being a laminate of different sheet materials covering an external surface of the core element.

2. A printhead assembly as claimed in claim 1, wherein the laminate comprises a plurality of metal layers which together define the shell with a coefficient of thermal expansion which is comparable to that of silicon.

3. A printhead assembly as claimed in claim 2, wherein one of the layers has a first co-efficient of thermal expansion and is located between a pair of layers each having a second co-efficient of thermal expansion.

4. A printhead assembly as claimed in claim 3, wherein the first co-efficient of thermal expansion is greater than the second co-efficient of thermal expansion.

5. A printhead assembly as claimed in claim 4, wherein the second co-efficient of thermal expansion is about $1.3\times10^{-6}$ m/° C.

6. A printhead assembly as claimed in claim 4, wherein the first co-efficient of thermal expansion exceeds $2.5\times10^{-6}$ m/° C.

7. A printhead assembly as claimed in claim 1, wherein the molding is a micro-molding.

8. A printhead assembly as claimed in claim 1, wherein the core element is molded from plastics material.

* * * * *